US007945983B1

(12) United States Patent
Neu

(10) Patent No.: US 7,945,983 B1
(45) Date of Patent: May 24, 2011

(54) FLOOR WIPE FOR USE WITH FOOT

(76) Inventor: Kenneth Neu, Fort Myers, FL (US)

( * ) Notice: Subject to any disclaimer, the term of this patent is extended or adjusted under 35 U.S.C. 154(b) by 429 days.

(21) Appl. No.: 12/229,578

(22) Filed: Aug. 25, 2008

(51) Int. Cl.
*A47L 13/16* (2006.01)
*A47L 13/282* (2006.01)

(52) U.S. Cl. ..... 15/227; 15/118; 36/15

(58) Field of Classification Search ..... 15/114, 15/115, 118, 227, 228, 229.11–229.13; 36/11.5, 36/15

See application file for complete search history.

(56) References Cited

U.S. PATENT DOCUMENTS 2,738,533 A * 3/1956 Peterson ..... 15/227
5,569,521 A * 10/1996 Francoeur et al. ..... 428/171
6,052,856 A * 4/2000 DeMoya et al. ..... 15/227
7,814,605 B1 * 10/2010 Tippel ..... 15/114
2001/0047558 A1 * 12/2001 Ahern ..... 15/227
2006/0101667 A1 * 5/2006 Kane ..... 36/9 R
2006/0265828 A1 * 11/2006 Mallatt et al. ..... 15/227

* cited by examiner

*Primary Examiner* — Mark Spisich

(57) ABSTRACT

A floor wipe is provided in the general shape of a human foot and has a floor contact side and a foot contact side where a user would place their foot on the foot contact side of the device and manipulate the device about the floor to clean an area of the floor. The device has a first cleaning area, having a first characteristic, such as absorbency, about a toe placement end of the device and a second cleaning area, having a second characteristic, such as scouring, which is unique from the characteristic of the first cleaning area, about a heel placement end of the device. The foot contact side has structural configuration elements which resist the foot of the user from slipping there along during usage. These structural configuration elements include embroidery in the shape of human toes at the toe placement end of the device.

16 Claims, 3 Drawing Sheets

FIG. 4
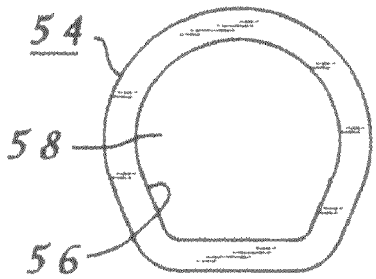
FIG. 7
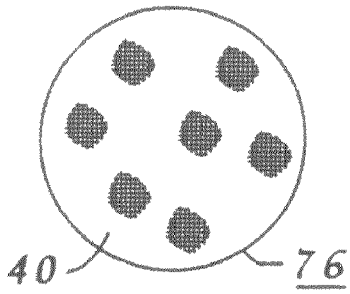
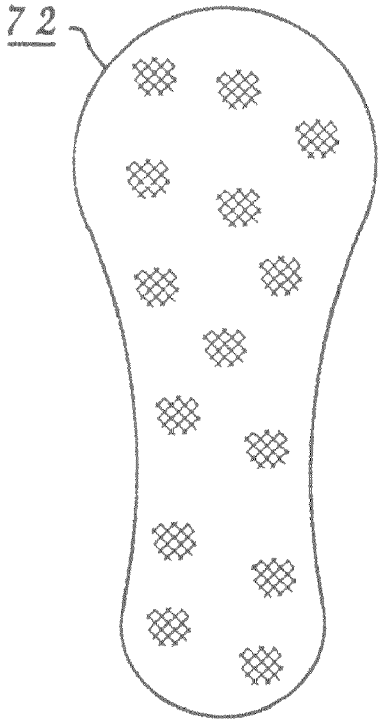
FIG. 5
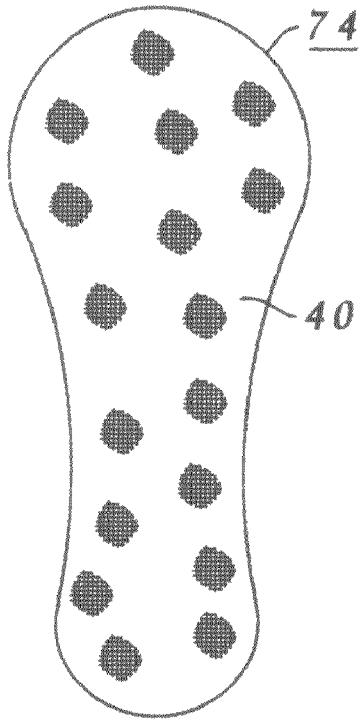
FIG. 6
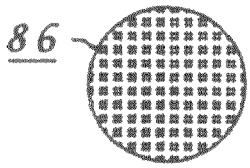
FIG. 9
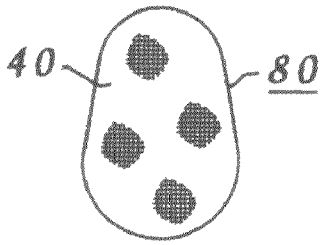
FIG. 8

FLOOR WIPE FOR USE WITH FOOT

BACKGROUND

1. Field of the Invention

Generally, the invention relates to devices and methods to wipe the surface of a floor. More specifically, the invention relates to such devices and methods where the device is placed on the floor and manipulated by placing a foot thereon and moving the device about to wipe, or otherwise clean, the surface of the floor.

2. Description of the Prior Art

Numerous devices have been proposed to assist a person in the cleaning of a surface of a floor. It is conventionally known to provide 'floor mops' having a pad, or other cleaning arrangement, attached to an elongated handle where the person standing generally upright holds the handle and manipulates the floor contact portion for movement about the surface of the floor. It is known in the art to provide for two opposing cleaning surfaces, having unique cleaning characteristics, on the cleaning arrangement portion. This arrangement provides for the user to select which cleaning surface to utilize during a cleaning procedure. One example of this is a sponge pad having an abrasive, or at least stiffer material, attached to the forward edge. In use, when a loosening or removal of debris or dirt is desired where the sponge pad is insufficient for the task the user would rotate the assembly one hundred and eighty degrees and utilize the scouring pad portion to remove the dirt desired then rotate the assembly another one hundred and eighty degrees (in either direction) and continue the cleaning procedure with the sponge portion.

The problem with such handled 'mops' is that they are large and long, due to the handle, and typically will be stored in a storage location where it must be removed from and returned to during each use. This makes such devices less desirable due to the extra time required to get them from their respective storage location, use them, clean them subsequent to usage and then return them to their respective storage location. The cleaning process for the handled 'mop' can also be awkward, due to the protruding handle, when the user merely wishes to rinse the floor contact portion off in a sink, such as in a kitchen or bathroom. When the user merely wishes to clean up a spill on the floor the user will often bypass the conventional handled 'mop' and merely bend over and clean up the affected area with a towel, either of cloth or of the paper variety. This procedure has been known to result in injury while the user is bending over and manipulating the towel using a hand of the user. Back injuries are relatively common from these procedures. Often the user will merely drop the towel on the floor and then attempt to manipulate the towel with the foot, whether bare or having a shoe thereon. This arrangement often results in the towel not being flat while on the floor but rather be bunched up or folded at irregular positions. Often the user will end up getting the material that they are attempting to clean up from the floor on their feet or on their shoes due to nonuniform orientation of the towel relative to the foot or shoe.

Many Patents have been issued for devices which permit the user to manipulate a cleaning surface utilizing a foot of the user. Typically, such devices are in the form of a shoe or booty which is placed on the foot while the foot is elevated above the floor. These devices provide excellent cleaning qualities, such as being maintained in a proper orientation relative to the foot during the cleaning procedure. Unfortunately, such devices are awkward to place on the foot and awkward to remove, especially when soiled or damp from the cleaning procedure performed on the floor. Typically, such devices have extraordinary structures to ensure retention on the foot during the transfer from the installation position elevated above the floor, to the floor where the cleaning procedure occurs and back to an elevated position above the floor where removal occurs. Various enhancements have been proposed for devices in this class including removable scrubbing pads and simpler retention arrangements.

As detailed above, various devices, and associated methods, have been proposed to provide for cleaning of small spills, or other messes, from the surface of floors. These attempts have been less efficient than desired. As such, it may be appreciated that there continues to be a need for a simple cleaning assembly which may be placed on the floor, manipulated by a foot of the user with confidence of retention of placement orientation relative to the foot, which has a first cleaning surface proximate to toes of the foot and a second cleaning surface, unique from the first cleaning surface, proximate the heel of the foot and which may be readily rinsed by hand in a sink and merely hung to dry. The present invention substantially fulfills these needs.

SUMMARY

In view of the foregoing disadvantages inherent in the known devices for wiping spills from floors, your applicant has devised a floor wipe for use with a foot to provide for easy clean up of small areas of a floor during a cleaning procedure. The floor wipe has a foot contact side, a floor contact side, a toe end cleaning area and a heel end cleaning area. The foot contact side provides for contact with the foot during the cleaning procedure. The floor contact side provides for contact with the floor during the cleaning procedure. The floor contact side is positioned on the floor wipe opposing the foot contact side. The toe end cleaning area is positioned on the floor contact side of the floor wipe and has a first cleaning characteristic during the cleaning procedure. The heel end cleaning area is positioned on the floor contact side of the floor wipe and having a second cleaning characteristic. The first cleaning characteristic is unique from the second cleaning characteristic where the floor wipe is versatile enough to handle many small floor cleaning operations.

My invention resides not in any one of these features per se, but rather in the particular combinations of them herein disclosed and it is distinguished from the prior art in these particular combinations of these structures for the useful functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for a simple device which may be merely dropped on a floor having a spill or other small area in need of cleaning and manipulated by a user by placement of their foot thereon utilizing simple movement of the foot relative to the area to be cleaned while the user remains in a standing position.

Other objects include;

a) to provide for the device to have clearly defined and identifiable cleaning and foot contact surfaces where the user may be confident during usage of proper usage.

b) to provide for a first cleaning surface proximate the toe area of the device and a second cleaning surface, having unique characteristics from the first cleaning surface, proximate the heel area of the device.

c) to provide for the first cleaning surface proximate the toe area of the device to be for wiping and absorbing spills from the floor to be cleaned.

d) to provide for the second cleaning surface proximate the heel area of the device to be for scouring areas of the floor to be cleaned to loosen dirt and debris therefrom.

e) to provide for the foot contact surface to have a structural configuration which prevents slippage between the device and the foot of the user during movement by the user about the floor to be cleaned.

f) to provide for the structural configuration associated with the foot contact surface to include embroidery at least about the toe area to provide for non slip contact with the foot of the user.

g) to provide for the embroidery about the toe area of the foot contact surface to be in the shape of human toes.

h) to provide for the toe area of the device to have a thicker composition of material than the central portion of the device adjacent to and behind the toe area of the device.

i) to provide for the heel area of the device to have a thicker composition of material than the central portion of the device adjacent to and in front of the heel area of the device.

j) to provide for the toe area end of the device to have a semi-rigid material positioned therein which provide a surrounding barrier to retain the device relative to a portion of the foot behind the toes of the foot.

k) to provide for the device to have an arrangement to permit the device to be hung, especially for drying.

l) to provide for the arrangement to permit the device to be hung to take the form of an aperture through the device at the heel area end of the device.

m) to provide for the device to be attractive enough to be displayed in kitchen and bathroom areas of homes of even the most discriminating persons.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 4 is a top plan view of a semi-rigid insert.

FIG. 5 is a top plan view of an upper piece.

FIG. 6 is a top plan view of a lower piece.

FIG. 7 is a top plan view of a toe pad.

FIG. 8 is a top plan view of a heel pad.

FIG. 9 is a top plan view of scouring material.

DESCRIPTION

Figure 1:
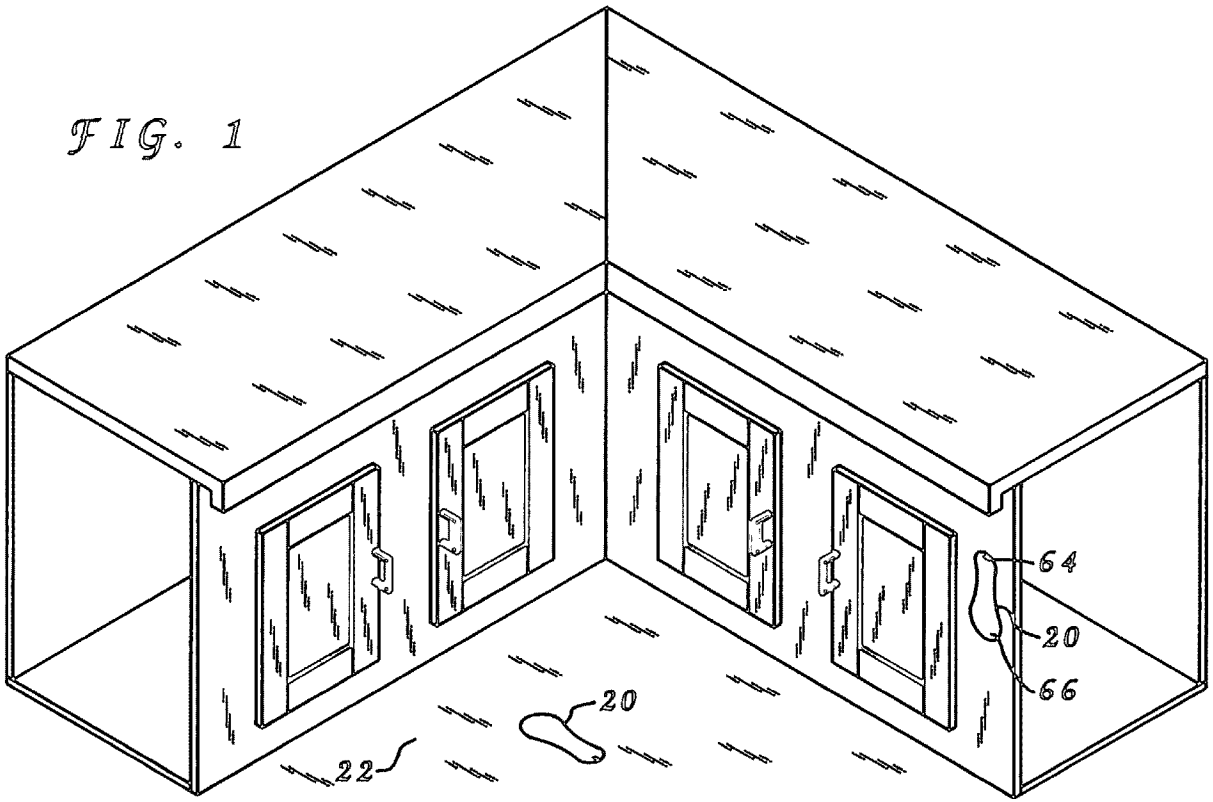
FIG. 1 is a perspective view of a portion of a kitchen.

Many different devices having features of the present invention are possible. The following description describes the preferred embodiment of select features of those devices and various combinations thereof. These features may be deployed in various combinations to arrive at various desired working configurations of devices.

Reference is hereafter made to the drawings where like reference numerals refer to like parts throughout the various views.

A floor wipe 20 is depicted for use with a foot, conventionally known and not depicted in any of the various views, to provide for easy clean up of small areas of a floor 22, see FIG. 1, during a cleaning procedure. Floor wipe 20 has a symmetrical shape 24 generally corresponding to the shape of a human foot print where floor wipe 20 can be used with either foot, the right or the left. Floor wipe 20 has a foot contact side 26, see FIG. 2, to provide for contact with the foot during the cleaning procedure. Floor wipe 20 has a floor contact side 28, see FIG. 3, to provide for contact with floor 22 during the cleaning procedure. Floor contact side 28 is positioned opposing foot contact side 26 on floor wipe 20. Floor wipe 20 has a toe end cleaning area 30 positioned on floor contact side 28 of floor wipe 20. Toe end cleaning area 30 has a first cleaning characteristic 32 for use during the cleaning procedure. Preferably first cleaning characteristic 32 is generally associated with a wiping and absorbent portion of the cleaning procedure. Floor wipe 20 has a heel end cleaning area 34 positioned on floor contact side 28 of floor wipe 20. Heel end cleaning area 34 has a second cleaning characteristic 36 for use during the cleaning procedure. Preferably second cleaning characteristic 36 is generally associated with a scouring portion of the cleaning procedure. In any event, first cleaning characteristic 32 preferably will be unique relative to second cleaning characteristic 36.

A circular sewing pattern 38 is positioned on floor contact side 28 and is generally centered on toe end cleaning area 30. Preferably floor contact side 28 of floor wipe 20 at toe end cleaning area 30 is formed of a Terri cloth material 40. Ideally Terri cloth material 40 extends the entire length of floor contact side 28 of floor wipe 20 including under a cleaning material 42 associated with heel end cleaning area 34. Preferably a similar circular sewing pattern will be also be positioned on floor contact side 28 and generally centered on heel end cleaning area 34, and under any deployed cleaning material positioned thereat.

Figure 2:
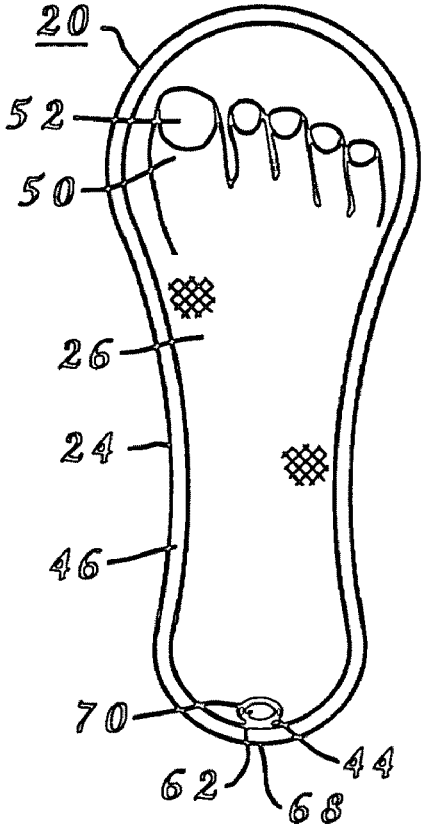
FIG. 2 is a top plan view of a floor wipe.
Figure 3:
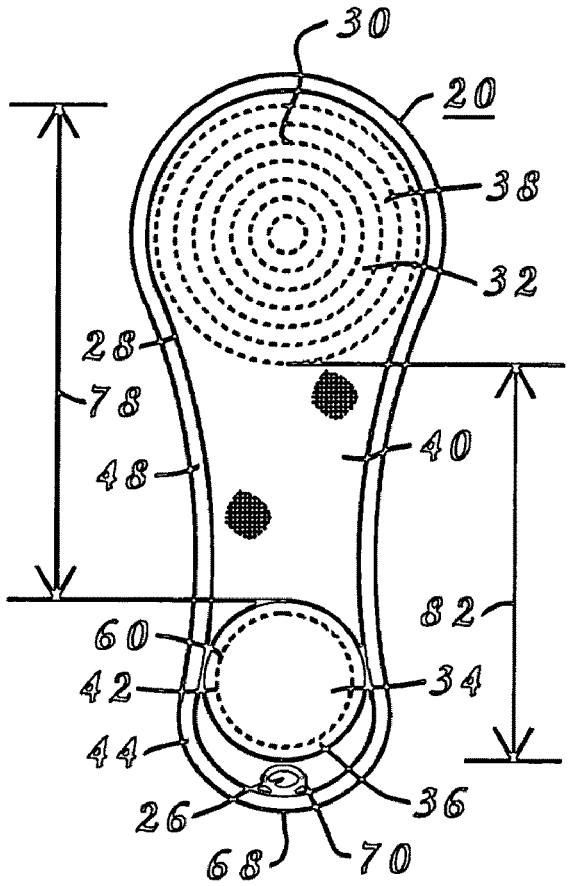
FIG. 3 is a bottom plan view of the floor wipe.

An embroidered border 44 extends around floor wipe 20 and extends onto a perimeter 46 of foot contact side 26, see FIG. 2, and onto a perimeter 48 of floor contact side 28, see FIG. 3. Embroidered border 44 ensures aesthetic appeal of floor wipe 20 while enhancing structural integrity of floor wipe 20. An embroidered pattern 50 is positioned on foot contact side 26, see FIG. 2, opposing toe end cleaning area 30 of floor contact side 28. Preferably, embroidered pattern 50 has a shape 52 generally associated with toes and nails of the foot.

A semi-rigid insert 54, see FIG. 4, is positioned between foot contact side 26 and floor contact side 28 and is generally aligned with toe end cleaning area 30. Semi-rigid insert 54 has a perimeter wall 56 extending at least partially around a containment area 58. Containment area 58 of semi-rigid insert 54 acts to assist in retention of the foot in proper orientation on floor wipe 20 during the cleaning procedure.

Preferably attachment of semi-rigid insert 54 to floor wipe 20 occurs utilizing stitching, associated with sewing, which penetrates semi-rigid insert 54.

Hanging means, in the preferred form of an aperture 62, see FIG. 2 and FIG. 3, provides for a hanging storage retention 64, see FIG. 1, of floor wipe 20 in a generally vertical orientation 66 while not being used for the cleaning procedure. Aperture 62 penetrates floor wipe 20 from foot contact side 26 to floor contact side 28 and at a rearward extent 68 of floor wipe 20 behind heel end cleaning area 34 of floor contact side 28. An embroidered border 70 is positioned around aperture 62 to ensure aesthetic appeal of floor wipe 20 generally, and aperture 62 specifically, while enhancing structural integrity of floor wipe 20 generally, and aperture 62 specifically. Many other structural configurations may be provided to provide the desired hanging feature.

Floor wipe 20 is preferably constructed of the following pieces assembled using the following assembly steps. Wide variations are possible of course in selection of pieces and in selection of assembly steps. An upper piece 72, see FIG. 5, preferably of a long lasting durable fabric material. A lower piece 74, see FIG. 6, preferably of an absorbent material such as Terri cloth material 40. Semi-rigid insert 54, see FIG. 4, preferably of a non absorbent material such as a plastic. A toe pad 76, see FIG. 7, preferably of Terri cloth material 40, forms an extra layer of absorbent material between floor contact side 28 and foot contact side 26 and generally aligned with toe end cleaning area 30 of floor contact side 28. Toe pad 76 will extend along floor wipe 20 between floor contact side 28 and foot contact side 26 less then a distance 78, see FIG. 3, to heel end cleaning area 34 of floor contact side 28. A heel pad 80, see FIG. 8, preferably of Terri cloth material 40, forms an extra layer of material between floor contact side 28 and foot contact side 26 and generally aligned with heel end cleaning area 34 of floor contact side 28. Heel pad 80 will extend along floor wipe 20 between floor contact side 28 and foot contact side 26 less then a distance 82, see FIG. 3, to toe end cleaning area 30 of floor contact side 28. A scouring material 86, see FIG. 9, is provided which is suitable for mild abrasive contact with stubborn deposits on floor 22 during the cleaning procedure. During assembly the various pieces are formed of the respective materials.

Lower piece 74 and toe pad 76 are sewed together utilizing circular sewing pattern 38. If desired, two (2) toe pads 76 may be utilized at this point instead of a single toe pad 76. Lower piece 74 and heel pad 80 are sewed together utilizing a circular sewing pattern, not shown but similar to circular sewing pattern 38. If desired, two (2) heel pads 80 may be utilized at this point instead of a single heel pad 80. Scouring material 86 is then attached, preferably by a stitching, to lower piece 74 corresponding to placement of heel pad 80. Upper piece 72 has embroidered pattern 50 positioned thereon. Upper piece 72 and lower piece 74 are then connected utilizing stitching around the edges and spaced slightly in from the edges. Then embroidered border 70 is installed to completely penetrate from upper piece 72 through lower piece 74 and generally aligned with the eventual location of aperture 62. Subsequent to installation of embroidered border 70, aperture 62 is formed through from upper piece 72 through lower piece 74. At this point floor wipe 20 is generally compete.

Scouring material 86 may be permanently attached to floor wipe 20, as depicted by stitching 60, see FIG. 3, or may be removably attached utilizing some suitable attachment method, such as one portion of a hook and loop fastener attached to floor wipe 20 while the opposing portion of the hook and loop fastener is attached to scouring material 86. This arrangement provides for removal and replacement of scouring material 86 when desired or required.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A floor wipe for use with a foot to provide for easy clean up of small areas of a floor during a cleaning procedure, the floor wipe comprising:

a) a foot contact side to provide for contact with the foot during the cleaning procedure;

b) a floor contact side to provide for contact with the floor during the cleaning procedure, the floor contact side opposing the foot contact side;

c) a toe end cleaning area positioned on the floor contact side of the floor wipe and having a first cleaning characteristic during the cleaning procedure, the first cleaning characteristic generally associated with a wiping and absorbent portion of the cleaning procedure;

d) a heel end cleaning area positioned on the floor contact side of the floor wipe and having a second cleaning characteristic during the cleaning procedure, the second cleaning characteristic generally associated with a scouring portion of the cleaning procedure;

e) a circular sewing pattern on the floor contact side and generally centered on the toe end cleaning area.

2. The floor wipe defined in claim 1 further comprising a semi-rigid insert positioned between the foot contact side and the floor contact side and generally aligned with the toe end cleaning area, the semi-rigid insert having a perimeter wall extending at least partially around a containment area, the containment area of the semi-rigid insert to assist in retention of the foot in proper orientation on the floor wipe during the cleaning procedure.

3. The floor wipe defined in claim 1 further comprising an embroidered border and an embroidered toe pattern, the embroidered border extending around the floor wipe and extending onto a perimeter of the foot contact side and onto a perimeter of the floor contact side, the embroidered toe pattern having a shape generally associated with toes and nails of the foot and positioned on the foot contact side opposing the toe end cleaning area of the floor contact side.

4. The floor wipe defined in claim 1 further comprising hanging means to provide for a hanging storage retention of the floor wipe in a generally vertical orientation while not being used for the cleaning procedure.

5. The floor wipe defined in claim 4 wherein the hanging means further comprises an aperture penetrating the floor wipe from the foot contact side to the floor contact side and at a rearward extent of the floor wipe behind the heel end cleaning area of the floor contact side.

6. The floor wipe defined in claim 1 further comprising an extra layer of absorbent material between the floor contact side and the foot contact side and generally aligned with the toe end cleaning area of the floor contact side, the extra layer of absorbent material extending along the floor wipe between the floor contact side and the foot contact side less then the distance to the heel end cleaning area of the floor contact side.

7. A floor wipe for use with a foot to provide for easy clean up of small areas of a floor during a cleaning procedure, the floor wipe comprising:

a) a foot contact side to provide for contact with the foot during the cleaning procedure;

b) a floor contact side to provide for contact with the floor during the cleaning procedure, the floor contact side opposing the foot contact side;

c) a toe end cleaning area positioned on the floor contact side of the floor wipe and having a first cleaning characteristic during the cleaning procedure;

d) a heel end cleaning area positioned on the floor contact side of the floor wipe and having a second cleaning characteristic;

e) a semi-rigid insert positioned between the foot contact side and the floor contact side and generally aligned with the toe end cleaning area, the semi-rigid insert having a perimeter wall extending at least partially around a containment area, the containment area of the semi-rigid insert to assist in retention of the foot in proper orientation on the floor wipe during the cleaning procedure.

8. The floor wipe defined in claim 7 further comprising an extra layer of absorbent material between the floor contact side and the foot contact side and generally aligned with the toe end cleaning area of the floor contact side, the extra layer of absorbent material extending along the floor wipe between the floor contact side and the foot contact side less then the distance to the heel end cleaning area of the floor contact side.

9. The floor wipe defined in claim 7 further comprising a circular sewing pattern on the floor contact side and generally centered on the toe end cleaning area.

10. The floor wipe defined in claim 7 further comprising attachment of the semi-rigid insert to the floor wipe utilizing a sewing which penetrates semi-rigid insert.

11. The floor wipe defined in claim 7 wherein the floor contact side of the floor wipe at the toe end cleaning area is formed of a Terri cloth material.

12. The floor wipe defined in claim 7 further comprising an extra layer of absorbent material between the floor contact side and the foot contact side and generally aligned with the toe end cleaning area of the floor contact side, the extra layer of absorbent material extending along the floor wipe between the floor contact side and the foot contact side less then the distance to the heel end cleaning area of the floor contact side and further comprising attachment of the semi-rigid insert to the floor wipe utilizing a sewing which penetrates semi-rigid insert.

13. A floor wipe for use with a foot to provide for easy clean up of small areas of a floor during a cleaning procedure, the floor wipe comprising:

a) a foot contact side to provide for contact with the foot during the cleaning procedure;

b) a floor contact side to provide for contact with the floor during the cleaning procedure, the floor contact side opposing the foot contact side;

c) a toe end cleaning area positioned on the floor contact side of the floor wipe and having a first cleaning characteristic during the cleaning procedure;

d) a heel end cleaning area positioned on the floor contact side of the floor wipe and having a second cleaning characteristic;

e) an embroidered border extending around the floor wipe and extending onto a perimeter of the foot contact side and onto a perimeter of the floor contact side;

f) an embroidered pattern positioned on the foot contact side opposing the toe end cleaning area of the floor contact side and wherein the embroidered pattern further has a shape generally associated with toes and nails of the foot.

14. The floor wipe defined in claim 13 further comprises an aperture penetrating the floor wipe from the foot contact side to the floor contact side and at a rearward extent of the floor wipe behind the heel end cleaning area of the floor contact side, the aperture to provide for a hanging storage retention of the floor wipe in a generally vertical orientation while not being used for the cleaning procedure.

15. The floor wipe defined in claim 14 further comprising an embroidered border around the aperture.

16. The floor wipe defined in claim 13 wherein the floor wipe has a symmetrical shape generally corresponding to the shape of a human foot print wherein the floor wipe can be used with either foot.

* * * * *